US010711384B2

(12) United States Patent
Lee et al.

(10) Patent No.: US 10,711,384 B2
(45) Date of Patent: Jul. 14, 2020

(54) WASHING MACHINE

(71) Applicant: Samsung Electronics Co., Ltd., Suwon-si, Gyeonggi-do (KR)

(72) Inventors: Kang Hyun Lee, Suwon-si (KR); Jeong Kyo Jeoung, Yongin-si (KR); Hooi Joong Kim, Yongin-si (KR); Eung Ryeol Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 92 days.

(21) Appl. No.: 15/948,877

(22) Filed: Apr. 9, 2018

(65) Prior Publication Data

US 2019/0055688 A1 Feb. 21, 2019

(30) Foreign Application Priority Data

Aug. 18, 2017 (KR) ..... 10-2017-0105020

(51) Int. Cl.

*D06F 37/26* (2006.01)
*D06F 37/04* (2006.01)
*D06F 37/40* (2006.01)

(52) U.S. Cl.

CPC ..... *D06F 37/267* (2013.01); *D06F 37/04* (2013.01); *D06F 37/40* (2013.01)

(58) Field of Classification Search

CPC ..... D06F 37/267
See application file for complete search history.

(56) References Cited

U.S. PATENT DOCUMENTS 3,604,029 A * 9/1971 Bain ..... D06F 37/30 8/159
6,510,716 B1 1/2003 Kim et al.
9,080,279 B2 7/2015 Jun et al.
2004/0035155 A1 2/2004 Yoon
2004/0163429 A1 8/2004 Lim
(Continued)

FOREIGN PATENT DOCUMENTS

EP 3178983 A1 6/2017
EP 3348696 A1 7/2018
(Continued)

OTHER PUBLICATIONS

European Search Report dated Nov. 2, 2018 in connection with European Patent Application No. 18 16 6354, 13 pages.
(Continued)

*Primary Examiner* — Jason Y Ko

(57) ABSTRACT

A washing machine includes a tub. The washing machine includes a drum rotationally provided inside the tub to receive an object to be washed. The washing machine also includes a pulsator rotationally provided inside the drum. The washing machine further includes an outer shaft connected to the drum and including a cavity. The washing machine also includes an inner shaft connected to the pulsator and arranged in the cavity. The washing machine further includes a first pulley including a first axial coupler to be coupled to the outer shaft. The washing machine also includes a second pulley including a second axial coupler protruding toward the tub. The second axial coupler arranged in the cavity and coupled to the inner shaft.

14 Claims, 12 Drawing Sheets

(56) References Cited

U.S. PATENT DOCUMENTS

| | | | | |
|---|---|---|---|---|
| 2007/0245776 | A1* | 10/2007 | Reinwald | D06F 37/26 68/212 |
| 2015/0225885 | A1 | 8/2015 | Kim et al. | |
| 2017/0218551 | A1 | 8/2017 | Nakamoto | |

FOREIGN PATENT DOCUMENTS

| | | | |
|---|---|---|---|
| JP | H08066582 | A | 3/1996 |
| KR | 10-2001-0037667 | A | 5/2001 |
| KR | 10-2005-0087342 | A | 8/2005 |
| KR | 10-2005-0121011 | A | 12/2005 |
| KR | 10-2013-0044753 | A | 5/2013 |
| KR | 10-2014-0079257 | A | 6/2014 |
| KR | 10-2017-0057962 | A | 5/2017 |

OTHER PUBLICATIONS

International Search Report dated Aug. 21, 2018 in connection with International Patent Application No. PCT/KR2018/004840, 5 pages.

* cited by examiner

WASHING MACHINE

CROSS-REFERENCE TO RELATED APPLICATION

This application is related to and claims priority to Korean Patent Application No. 10-2017-0105020 filed on Aug. 18, 2017, the contents of which are incorporated herein by reference.

TECHNICAL FIELD

The present disclosure relates to a drum washer equipped with a pulsator to improve washing performance.

BACKGROUND

Washing machines are home appliances for doing laundry by means of electric power and may be classified into swirl type washers and drum type washers.

The swirl type washer has a pulsator provided inside a rotary tub, which generates a water stream, and the swirl type washer does laundry by using the water stream. The swirl type washer is of a top loading type in which an opening is formed on the top of the main body to throw clothes into the rotary tub.

The drum type washer does laundry by lifting and dropping clothes with a lifter formed on the inner circumferential face of the rotary tub. The drum type washer is of a front loading type in which an opening is formed on a side of the main body to throw clothes into the rotary tub.

Typically, a pulsator is not applied to the drum type washer, but in some cases, may be applied to improve washing performance. In a case of using a structure of a plurality of pulleys to drive the drum and the pulsator separately, washing space of the washing machine may become smaller and rotation of the plurality of pulleys may make noise.

SUMMARY

To address the above-discussed deficiencies, it is a primary object to provide a washing machine having a pulley with an improved form and assembly structure to increase washing space inside the washing machine.

Another aspect of the present disclosure provides a washing machine having a pulley with an improved form to reduce noise.

In accordance with an aspect of the present disclosure, a washing machine include a tub; a drum rotationally provided inside the tub for receiving an object to be washed; a pulsator rotationally provided inside the drum; an outer shaft connected to the drum and having a cavity; an inner shaft connected to the pulsator and arranged in the cavity; a first pulley having a first axial coupler to be coupled to the outer shaft; and a second pulley having a second axial coupler protruding toward the tub, the second axial coupler arranged in the cavity and coupled to the inner shaft.

The cavity may include a center cavity formed at a middle portion in the longitudinal direction of the outer shaft, and an end cavity having a larger diameter than the center cavity and formed at an end in the longitudinal direction of the outer shaft, and the second axial coupler may be arranged in the end cavity.

A diameter of the outer circumference of the second axial coupler may be smaller than the diameter of the end cavity.

At least a half of the second axial coupler in the longitudinal direction may be arranged in the cavity.

The first pulley may include a first hub, a first spoke radially extending from the first hub, and a first rim connected to an end of the first spoke, the first hub may include a first cylinder part and the first axial coupler, and the first axial coupler may protrude from the first cylinder part.

The washing machine may further include a first nut coupled to the outer circumferential face of the outer shaft to prevent the first pulley from falling out of the outer shaft.

The second axial coupler may be arranged at a position corresponding to the first nut with respect to the longitudinal direction of the outer shaft.

The first hub may include a first nut receiver concavely formed to receive the first nut.

The first nut receiver may be formed inside the first cylinder part.

The second pulley may include a second hub, a second spoke radially extending from the second hub, and a second rim connected to an end of the second spoke, the second hub may include a second cylinder part and the second axial coupler, and the second axial coupler may protrude from the second cylinder part.

The second axial coupler may include a fillet portion provided to be connected to the second cylinder part to reinforce the strength of the second axial coupler, and the fillet portion may have a larger outer circumferential diameter as it becomes nearer to the second cylinder part.

The washing machine may further include a second nut coupled to the outer circumferential face of the inner shaft to prevent the second pulley from falling out of the inner shaft.

The second hub may include a second nut receiver concavely formed to receive the second nut.

The second nut receiver may be formed inside the second cylinder part.

In accordance with another aspect of the present disclosure, a washing machine includes a tub; a drum rotationally provided inside the tub for receiving an object to be washed; a pulsator rotationally provided inside the drum; an outer shaft connected to the drum and having a cavity; an inner shaft connected to the pulsator and arranged in the cavity; a first pulley having a first hub coupled to the outer shaft and a first spoke radially extending from the first hub and having a first spoke recess formed in the front; and a second pulley having a second hub coupled to the inner shaft and a second spoke radially extending from the second hub and having a second spoke recess formed in the back.

The first pulley may be arranged between the tub and the second pulley.

The first spoke may include a plurality of first side walls facing each other and a first link wall for connecting the plurality of first side walls to form the first spoke recess, wherein the second spoke may include a plurality of second side walls facing each other and a second link wall for connecting the plurality of second side walls to form the second spoke recess, and wherein the first link wall and the second link wall may face each other.

The first spoke recess may have a first reinforcing rib formed to cross the first spoke recess to reinforce the strength of the first spoke, and wherein the second spoke recess may have a second reinforcing rib formed to cross the second spoke recess to reinforce the strength of the second spoke.

The washing machine may further include a cabinet receiving the tub and having a rear plate, wherein the first pulley and the second pulley each may have a middle portion in the radial direction formed to be closer to the rear plate than outer portions in the radial direction are.

In accordance with still another aspect of the present disclosure, a washing machine includes a cabinet having a front plate, a rear plate, and side plates; a tub contained in the cabinet; a rotary body rotationally provided inside the tub; a rotary shaft connected to the rotary body; a driving motor configured to generate driving force to drive the rotary shaft; and a pulley provided to transfer the driving force of the driving motor to the rotary shaft, formed to have a middle portion in the radial direction closer to the rear plate than outer portions in the radial direction are, and having a hub coupled to the rotary shaft and a spoke radially extending from the hub and having a spoke recess formed in the back.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
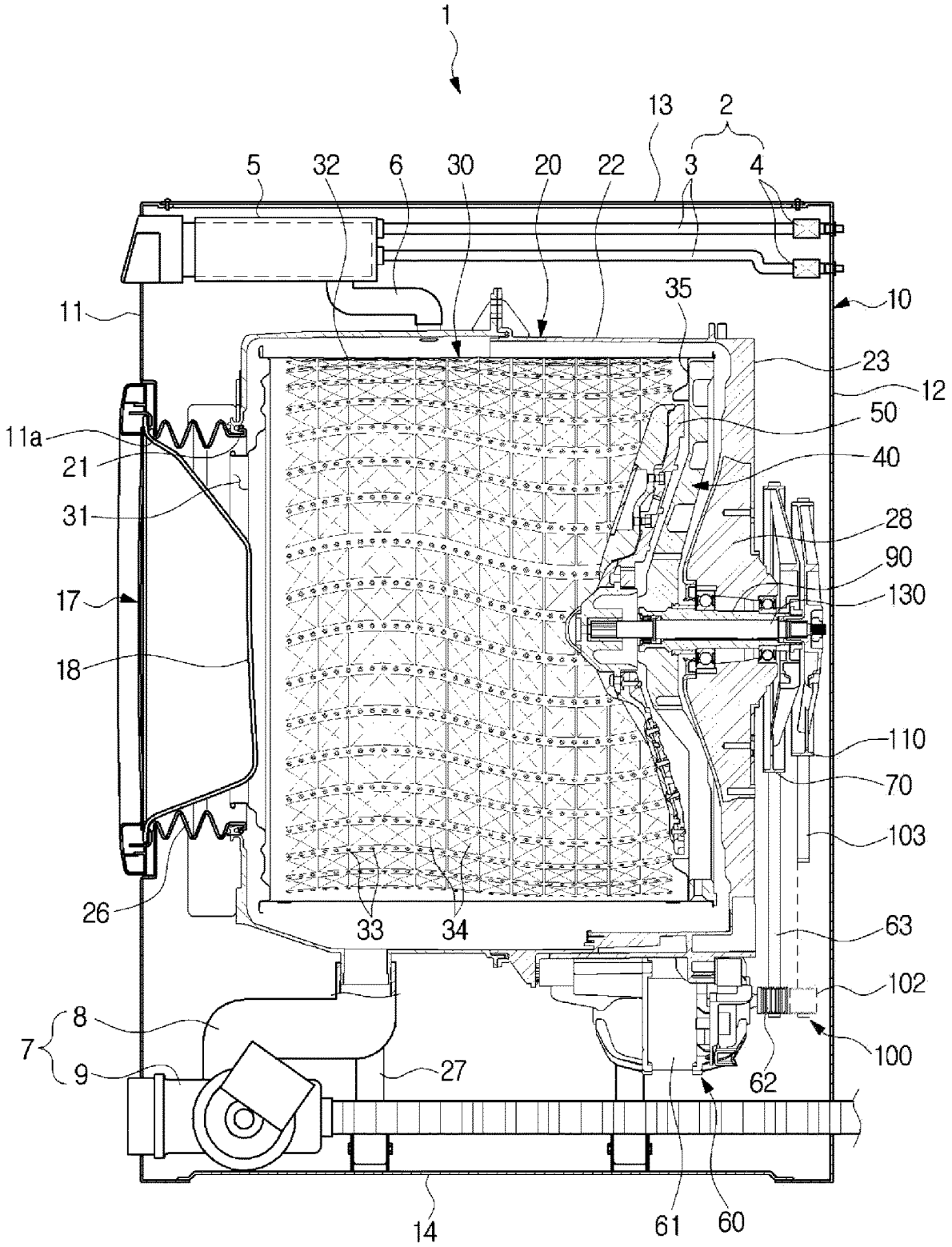
FIG. 1 illustrates a schematic side cross-sectional view of a main configuration of a washing machine, according to an embodiment of the present disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments of the present disclosure are provided to assist in a comprehensive understanding of the disclosure as defined by the claims and their equivalents. Accordingly, those of ordinary skilled in the art will recognize that various changes and modifications of the embodiments described herein can be made without departing from the scope and spirit of the disclosure.

Reference will now be made in detail to embodiments, examples of which are illustrated in the accompanying drawings, wherein like reference numerals refer to the like elements throughout.

Figure 2:
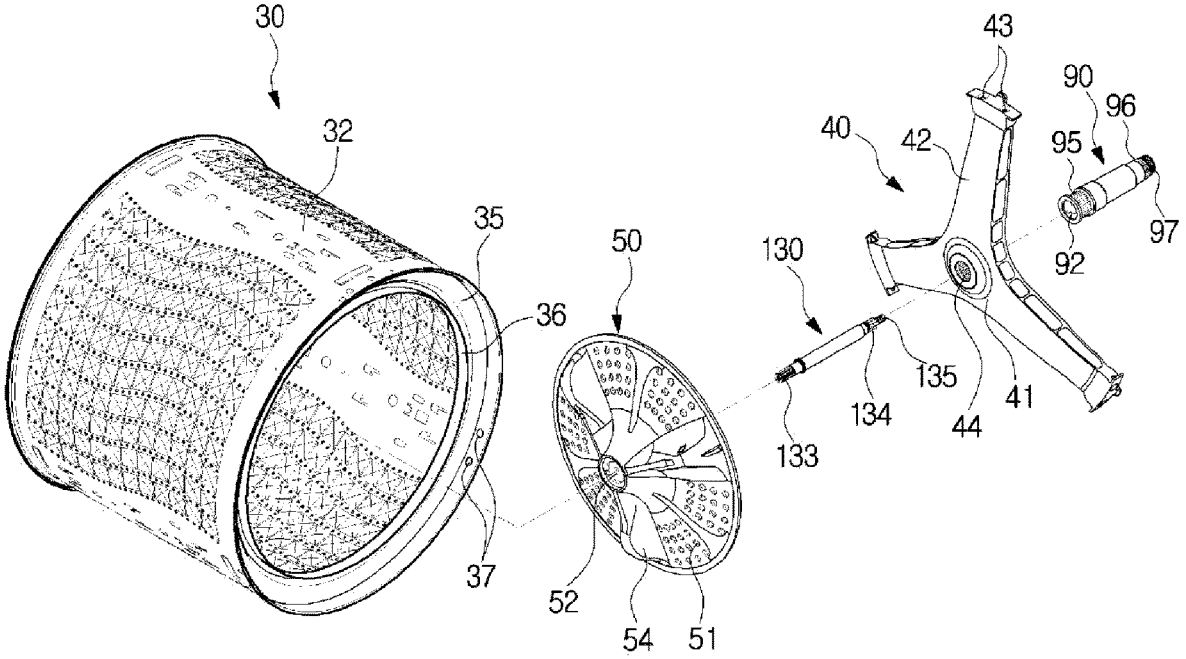
FIG. 2 illustrates a drum, a pulsator, an inner shaft, a flange, an outer shaft of the washing machine of FIG. 1 according to an embodiment of the present disclosure.
Figure 3:
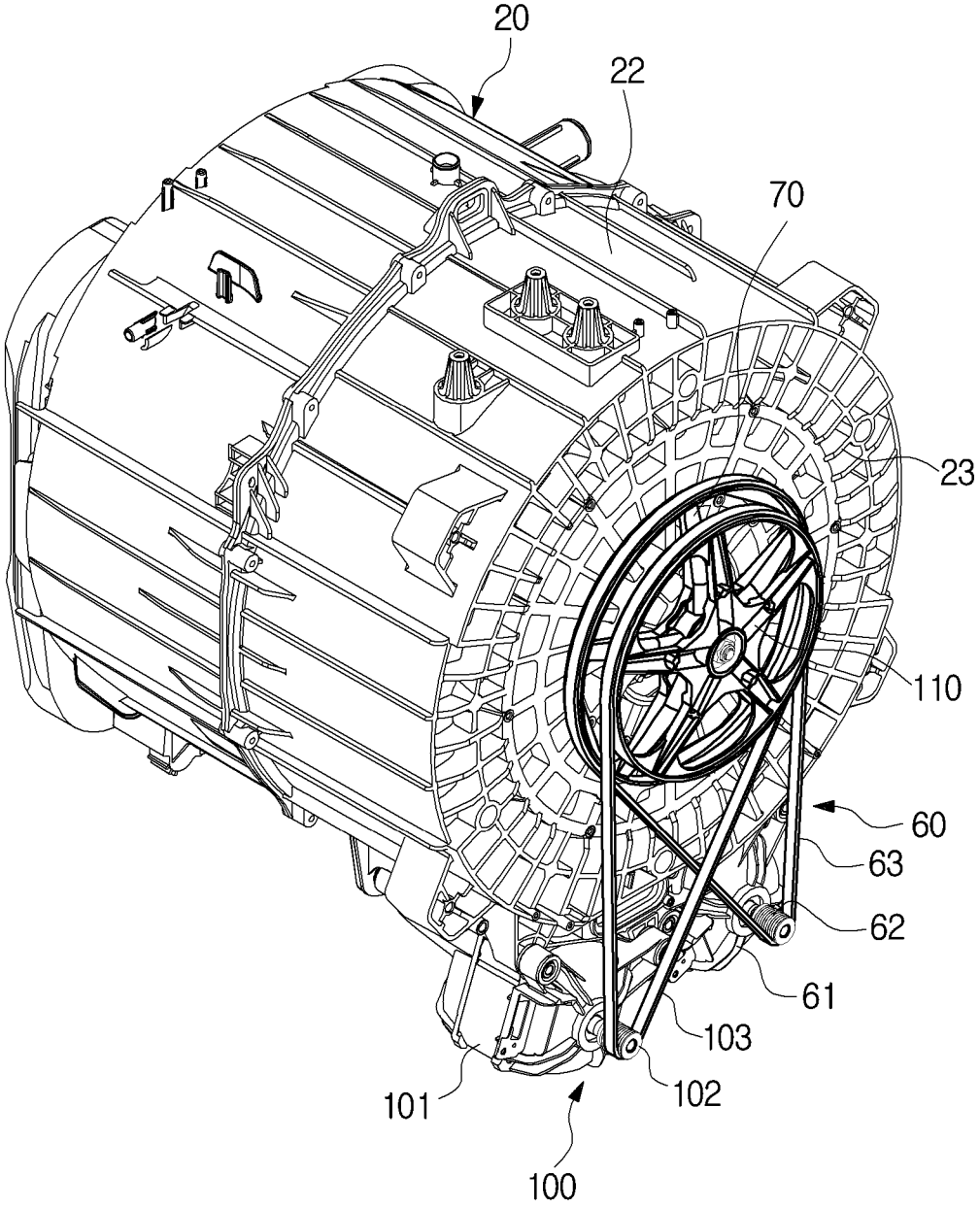
FIG. 3 illustrates a perspective view illustrating the back of a tub of the washing machine of FIG. 1 according to an embodiment of the present disclosure.
Figure 4:
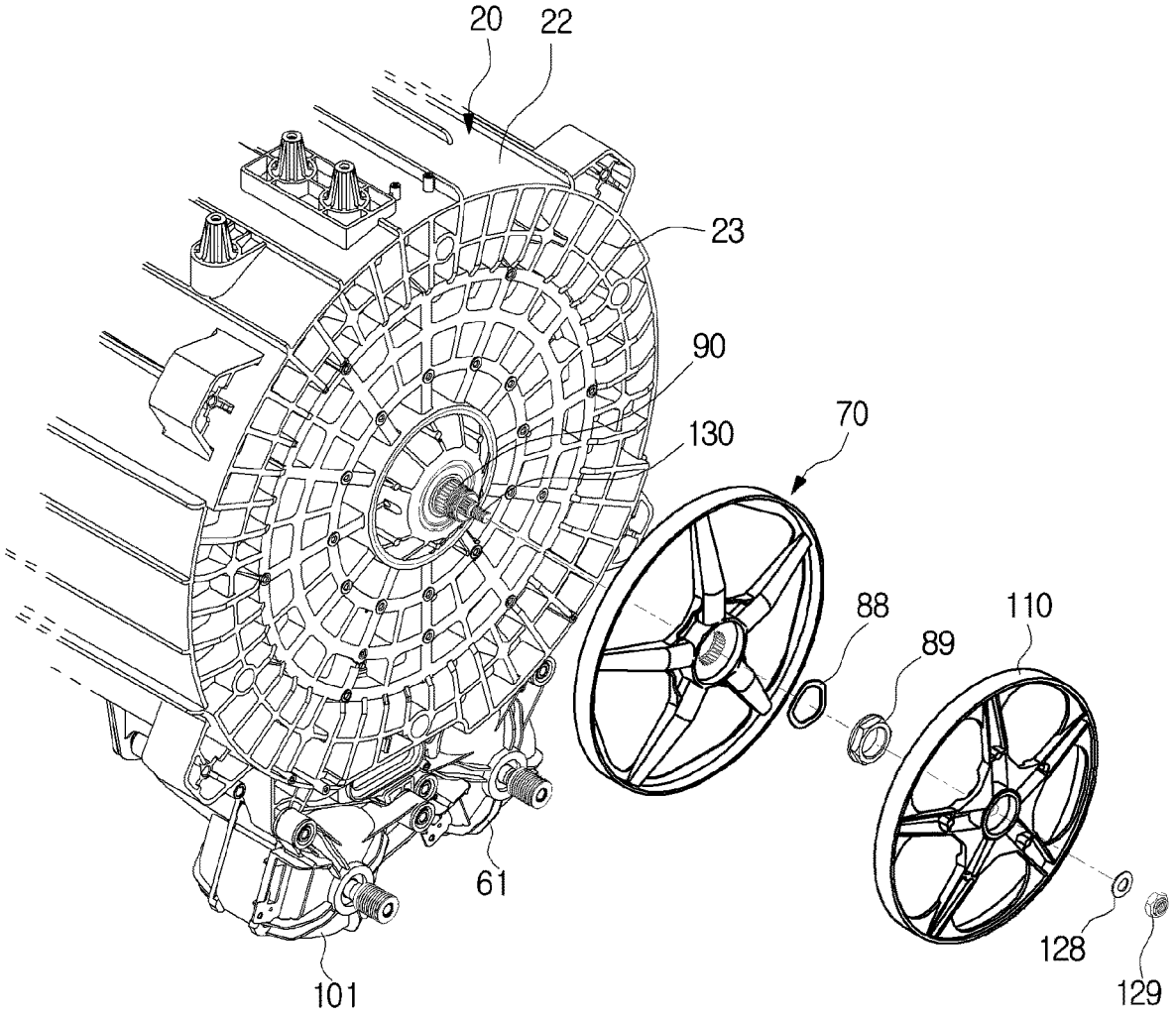
FIG. 4 illustrates an exploded view illustrating a first pulley and a second pulley separated from the washing machine of FIG. 3 according to an embodiment of the present disclosure.

FIG. 1 illustrates a schematic side cross-sectional view of a main configuration of a washing machine, according to an embodiment of the present disclosure. FIG. 2 illustrates a drum, a pulsator, an inner shaft, a flange, an outer shaft of the washing machine of FIG. 1, according to an embodiment of the present disclosure. FIG. 3 illustrates a perspective view illustrating the back of a tub of the washing machine of FIG. 1, according to an embodiment of the present disclosure. FIG. 4 illustrates an exploded view illustrating a first pulley and a second pulley separated from the washing machine of FIG. 3, according to an embodiment of the present disclosure.

Referring to FIGS. 1 to 4, in an embodiment, a washing machine 1 may include a cabinet 10 forming the exterior, a tub 20 provided inside the cabinet 10 for storing laundry water, a drum 30 rotationally provided inside the tub 20 for receiving an object to be washed, a pulsator 50 rotationally provided inside the drum 30 to produce a laundry water stream or apply washing power directly to the object, a first driver 60 provided to drive the drum 30, and a second driver 100 provided to drive the pulsator 50.

The cabinet 10 may have the form of almost a box, including a front plate 11, a rear plate 12, a top plate 13, a bottom plate 14, a left plate, and a right plate. An inlet 11*a* may be formed on the front plate 11 to throw in or draw out an object to or from the drum 30.

The inlet 11*a* may be opened or closed by a door 17 pivotally coupled with the cabinet 10. The door 17 may include a glass member 18 formed of a transparent material through which to see inside. For example, the glass member 18 may be made of a tempered glass. The glass member 18 may have a convex form toward the inner side of the drum 30 to prevent the object from moving toward the door 17 due to rotation of the drum 30.

The tub 20 may be provided inside the cabinet 10 to store laundry water. The tub 20 may be supported by a suspension 27. The tub 20 may include a cylindrical tub part 22 in a cylindrical form and a rear tub part 23 formed on the back of the cylindrical tub part 22. An opening 21 may be formed on the front of the tub 20 to correspond to the inlet 11*a* of the cabinet 10. A bearing housing 28 having an external bearing 91 installed therein may be insert-molded in a rear tub part 23 of the tub 20.

The inlet 11*a* of the cabinet 10 and the opening 21 of the tub 20 may be connected by a diaphragm 26. The diaphragm 26 may guide the object thrown in through the inlet 11*a* to the inner side of the drum 30 and prevent vibration that occurs when the drum 30 is rotated from being traveled to the cabinet 10.

The washing machine 1 may include a water supplier 2 for supplying laundry water into the tub 20. The water supplier 2 may include a water supply tube 3 for guiding the laundry water from an external water supply source and a water supply valve 4 for opening or closing the water supply tube 3.

A detergent supplier 5 may be provided in an upper portion of the cabinet 10 for supplying a detergent. The detergent supplier 5 may be connected to the tub 20 through a connection tube 6. Laundry water guided through the water supply tube 3 may pass through the detergent supplier 5 and may be supplied into the tub 20 together with the detergent.

The washing machine 1 may include a discharger 7 for discharging the laundry water from the tub 20. The discharger 7 may include a discharging tube 8 connected to a lower portion of the tub 20 to guide the laundry water out of the cabinet 10, and a discharging pump 9 for pumping the laundry water of the tub 20.

The drum 30 may be provided inside the tub 20 for receiving an object to be washed. The drum 30 may be arranged such that its center axis corresponds to the center axis of the tub 20. The drum 30 may include a cylindrical drum part 32 in a cylindrical form and a rear drum part 35 formed on the back of the cylindrical drum part 32. The cylindrical drum part 32 and the rear drum part 35 may be integrally formed or may be separately provided and assembled together. An opening 31 may be formed on the front of the drum 30 to correspond to the inlet 11*a* of the cabinet 10 and the opening 21 of the tub 20.

The cylindrical drum part 32 may have through holes 33 formed thereon for the laundry water of the tub 20 to flow in and out and laundry protrusions 34 protruding from the inner circumferential face of the cylindrical drum part 32 to rub against the object. There may be lifters (not shown) formed on the inner circumferential face of the cylindrical drum part 32 to lift and drop the object during the rotation of the drum 30. A pulsator install opening 36 may be formed on the rear drum part 35 to install the pulsator therein.

The drum 30 may be rotationally arranged inside the tub 20. That is, it can be said that the drum 30 is a rotary body. The drum 30 may wash the object by lifting and dropping the object to rub against it while being rotated.

The pulsator 50 may be installed inside the drum 30 to produce a washing stream or apply washing power directly to the object to wash the object. The pulsator 50 may move the object inward inside the drum 30, which is otherwise leaning toward the rear drum part 35 of the drum 30 while the drum 30 is rotating. The pulsator 50 may be located at the back of the inside of the drum 30.

The pulsator 50 may include a disc part 51 and at least one wing 54 protruding from the disc part 51 and arranged radially. The disc part 51 may have a pulsator axial hole 52 formed for an inner shaft 130 to be inserted thereto and combined therewith. Serration may be formed on the inner circumferential face of the pulsator axial hole 52 to be combined by serration with the inner shaft 130.

The pulsator 50 may be configured to be rotated inside the drum 30. That is, it can be said that the pulsator 50 is a rotary body. The pulsator 50 and the drum 30 may be configured to be rotated separately from each other. For example, just the drum 30 may be rotated, or just the pulsator 50 is rotated, or both the drum 30 and the pulsator 50 are rotated simultaneously. Even in the case that the drum 30 and the pulsator 50 are rotated simultaneously, they may be rotated at different speeds and in different directions.

The first driver 60 configured to drive the drum 30 may include a first driving motor 61 for producing driving force and a first power transfer device for transferring the driving force produced by the first driving motor 61 to the drum 30. The first driving motor 61 may be arranged under the tub 20.

The first power transfer device may include a flange 40 coupled to the rear drum part 35 of the drum 30, an outer shaft 90 coupled to the flange 40, a first pulley 70 coupled to the outer shaft 90, and a first belt 63 connecting a first motor shaft 62 of the first driving motor 61 and the first pulley 70.

The flange 40 may transfer the rotational force of the outer shaft 90 to the drum 30. The flange 40 may include a flange body 41 coupled to the outer shaft 90 and at least one arm 42 radially extending from the flange body 41.

A flange axial hole 44 may be formed in the flange body 41 for the outer shaft 90 to be inserted thereto and combined therewith. Serration may be formed on the inner circumferential face of the flange axial hole 44 to be combined by serration with the outer shaft 90.

The arm 42 may be radially formed to uniformly transfer the rotational force of the outer shaft 90 to the drum 30 and increase the torque. The arm 42 may be coupled to the drum 30 through a fastening member such as a screw, a bolt, a rivet, a pin, etc. For this, there may be fastening holes 43 on the arm 42 and fastening holes 37 on the drum 30.

Although the flange 40 is coupled with the drum 30 through the fastening member in the embodiment, the flange 40 may be integrated into the drum 30 by being inserted to the rear drum part 35 of the drum 30 in another embodiment.

The outer shaft 90 may be inserted to the arm 42 or coupled with the arm 42 by a fastening member.

The outer shaft 90 may transfer the driving force produced by the first driving motor 61 to the drum 30. That is, the outer shaft 90 may be called a rotary shaft provided to rotate the drum 30.

The outer shaft 90 may have one end coupled with the flange 40 and the other end coupled with the first pulley 70. For this, serration 95 may be formed on the outer circumferential face of one end of the outer shaft 90 to be combined by serration with the flange 40, and serration 96 may be formed on the outer circumferential face of the other end of the outer shaft 90 to be combined with the first pulley 70. The outer shaft 90 may be rotationally supported by an external bearing 91.

A cavity 92 may be formed in the outer shaft 90, and an inner shaft 130 may be inserted to the cavity 92. The cavity 92 may be formed along the longitudinal direction of the outer shaft 90.

A first nut 89 may be coupled with the outer circumferential face of the outer shaft 90 to prevent the first pulley 70 combined by serration with the outer shaft 90 from falling out. For this, a first nut coupler 97 with screw threads may be formed on the outer circumferential face of the outer shaft 90. A first washer 88 may be inserted between the first pulley 70 and the first nut 89 for uniformity of fastening force, pressure distribution, prevention of loosening, etc., of the first nut 89.

The first belt 63 winds around the outer edge of the first pulley 70, so the first pulley 70 may be rotated by receiving driving force from the first belt 63. The first pulley 70 may be coupled with the outer circumferential face of the outer shaft 90 to rotate the outer shaft 90. The first pulley 70 may be arranged between the rear tub part 23 and the rear plate 12 of the cabinet 10. The shape and assembly structure of the first pulley 70 will be described later.

The second driver 100 configured to drive the pulsator 50 may include a second driving motor 101 for producing driving force and a second power transfer device for transferring the driving force produced by the second driving motor 101 to the pulsator 50. The second driving motor 101 may be arranged under the tub 20 and next to the first driving motor 61.

The second power transfer device may include an inner shaft 130 coupled to the pulsator 50, a second pulley 110 coupled to the inner shaft 130, and a second belt 103 connecting a second motor shaft 102 of the second driving motor 101 and the second pulley 110.

The inner shaft 130 may transfer the driving force produced by the second driving motor 101 to the pulsator 50. That is, the inner shaft 130 may be called a rotary shaft provided to rotate the pulsator 50.

The inner shaft 130 may have one end coupled with the pulsator 50 and the other end coupled with the second pulley 110. For this, serration 133 may be formed on the outer circumferential face of one end of the inner shaft 130 to be coupled with the pulsator 50, and serration 134 may be formed on the outer circumferential face of the other end of the inner shaft 130 to be coupled with the second pulley 110.

The inner shaft 130 may be inserted to the cavity 92 of the outer shaft 90. An inside bearing 131 is provided between the inner circumferential face of the outer shaft 90 and the outer circumferential face of the inner shaft 130, and the inner shaft 130 may be rotationally supported by the inside bearing 131.

A second nut 129 may be coupled with the outer circumferential face of the inner shaft 130 to prevent the second pulley 110 combined by serration with the inner shaft 130 from falling out. For this, a second nut coupler 135 with screw threads may be formed on the outer circumferential face of the inner shaft 130. A second washer 128 may be inserted between the second pulley 110 and the second nut 129 for uniformity of fastening force, pressure distribution, prevention of loosening, etc., of the second nut 129.

The second belt 103 winds around the outer edge of the second pulley 110, so the second pulley 110 may be rotated by receiving driving force from the second belt 103. The second pulley 110 may be coupled to the outer circumferential face of the inner shaft 130 to rotate the inner shaft 130. The second pulley 110 may be arranged between the first pulley 70 and the rear plate 12 of the cabinet 10. The shape and assembly structure of the second pulley 110 will be described later.

Figure 5:
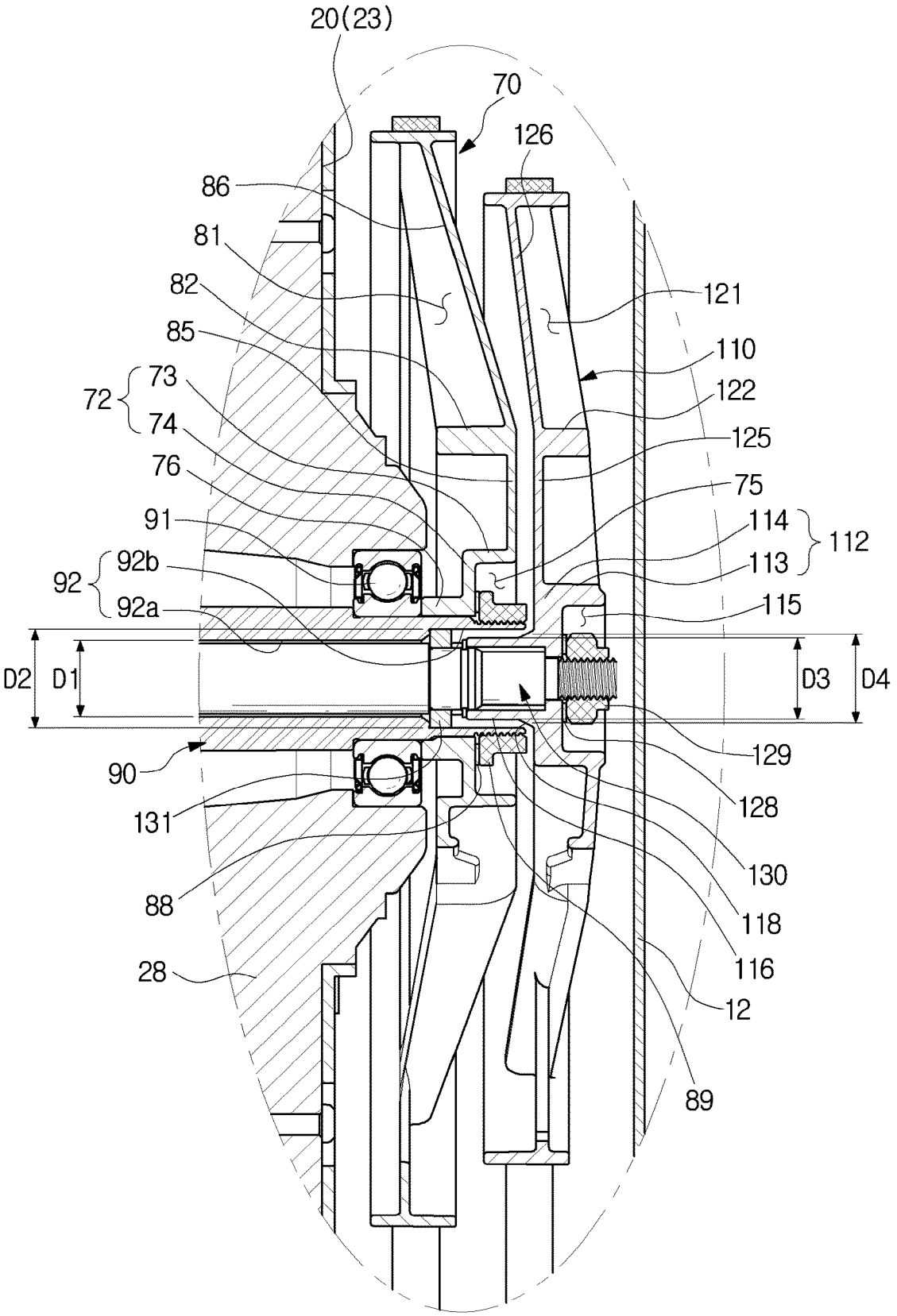
FIG. 5 illustrates an enlarged side cross-sectional view of a part of the back of the washing machine of FIG. 1 according to an embodiment of the present disclosure.
Figure 6:
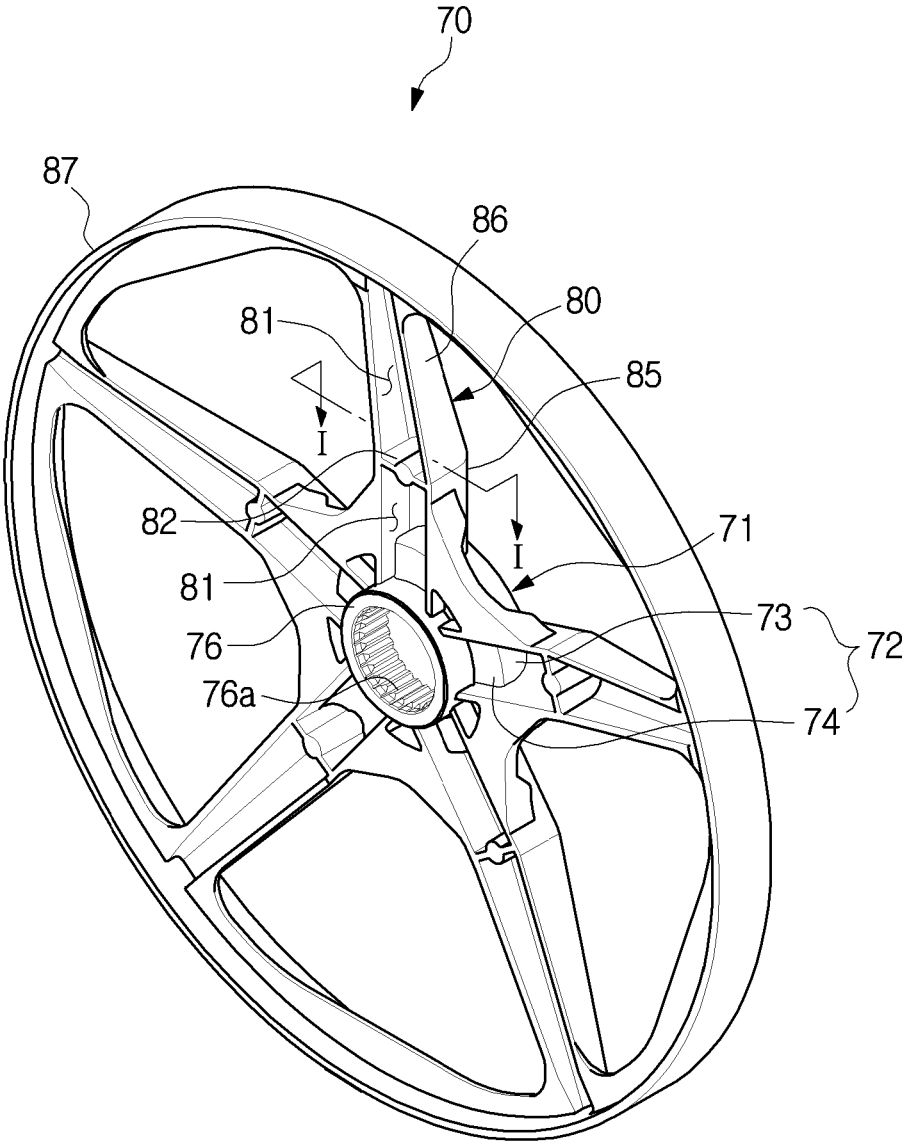
FIG. 6 illustrates a front perspective view of the first pulley of the washing machine of FIG. 1 according to an embodiment of the present disclosure.
Figure 7:
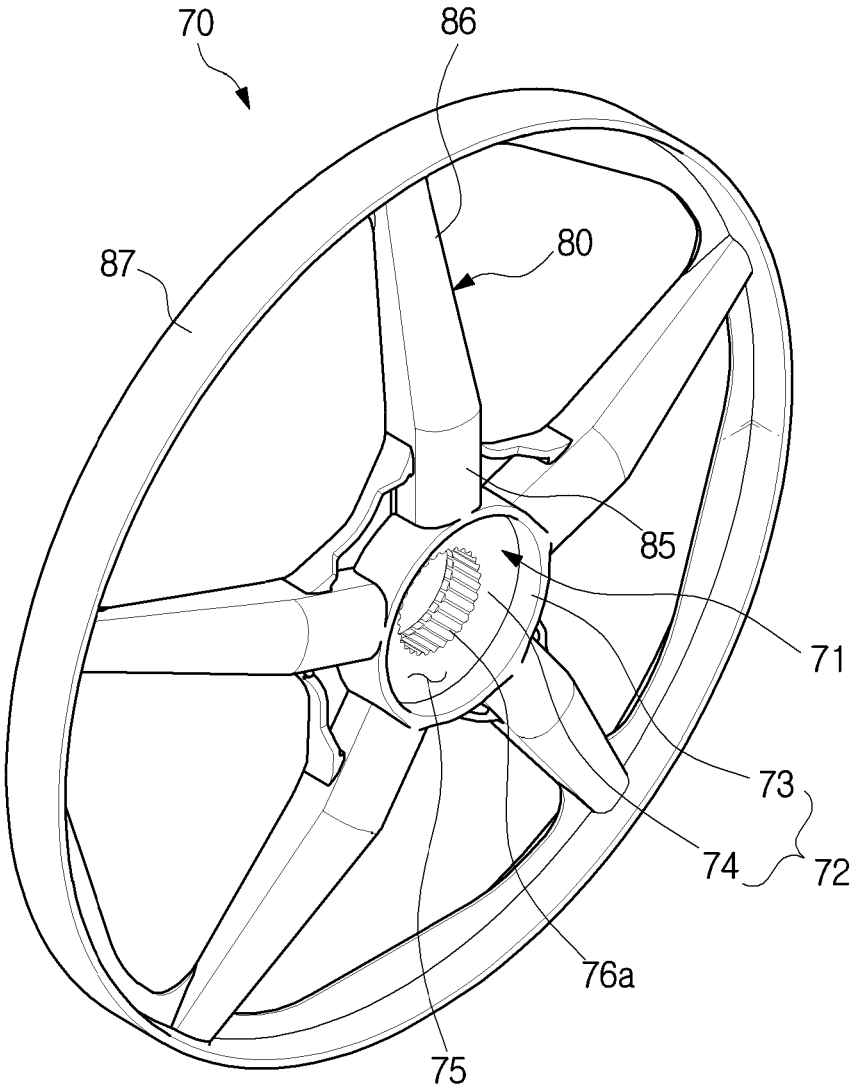
FIG. 7 illustrates a rear perspective view of the first pulley of the washing machine of FIG. 1 according to an embodiment of the present disclosure.
Figure 8:
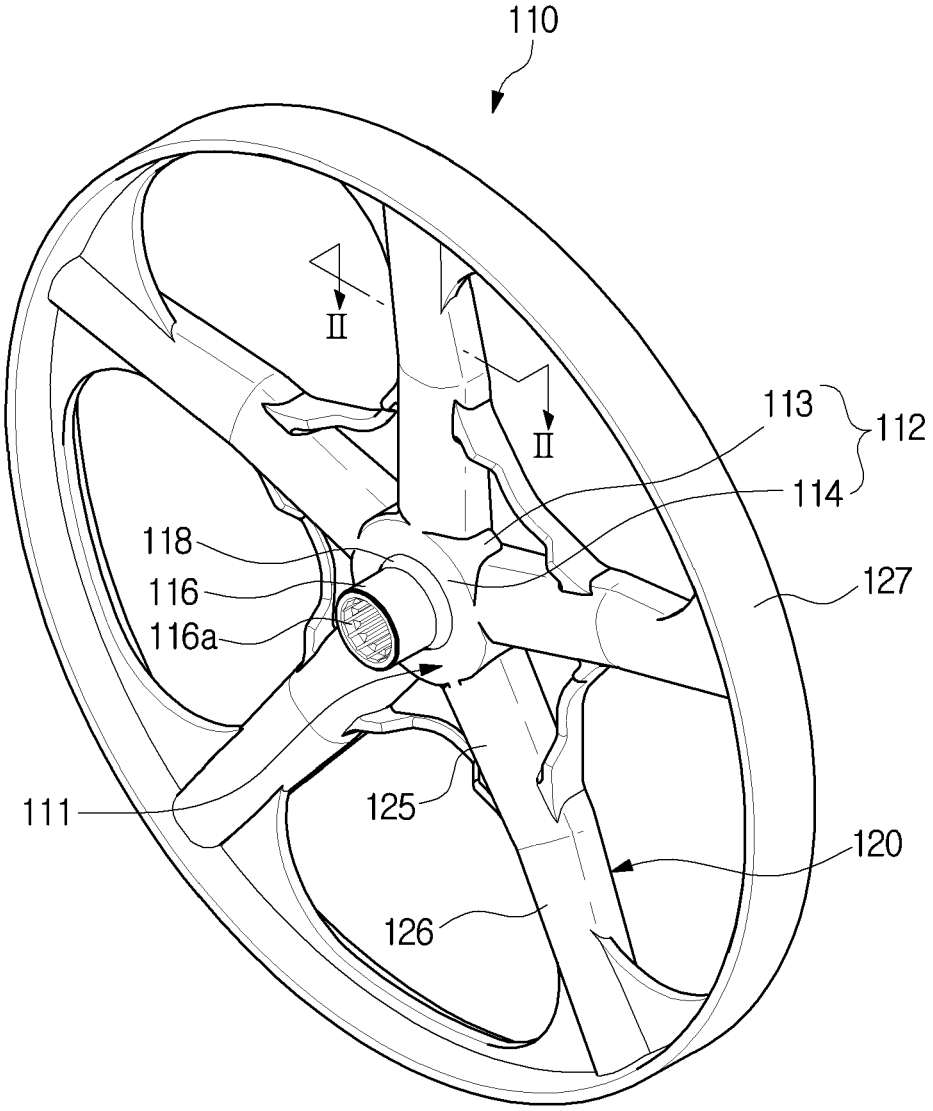
FIG. 8 illustrates a front perspective view of the second pulley of the washing machine of FIG. 1 according to an embodiment of the present disclosure.
Figure 9:
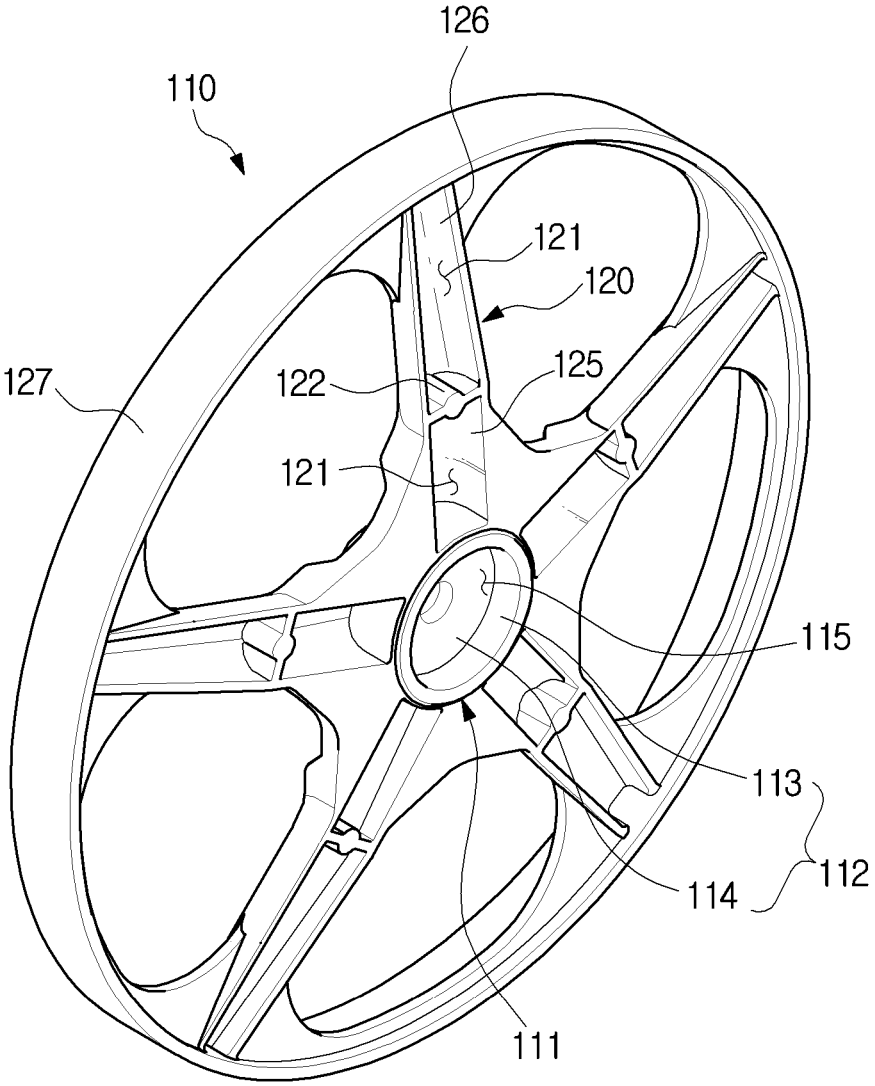
FIG. 9 illustrates a rear perspective view of the second pulley of the washing machine of FIG. 1 according to an embodiment of the present disclosure.
Figure 10:
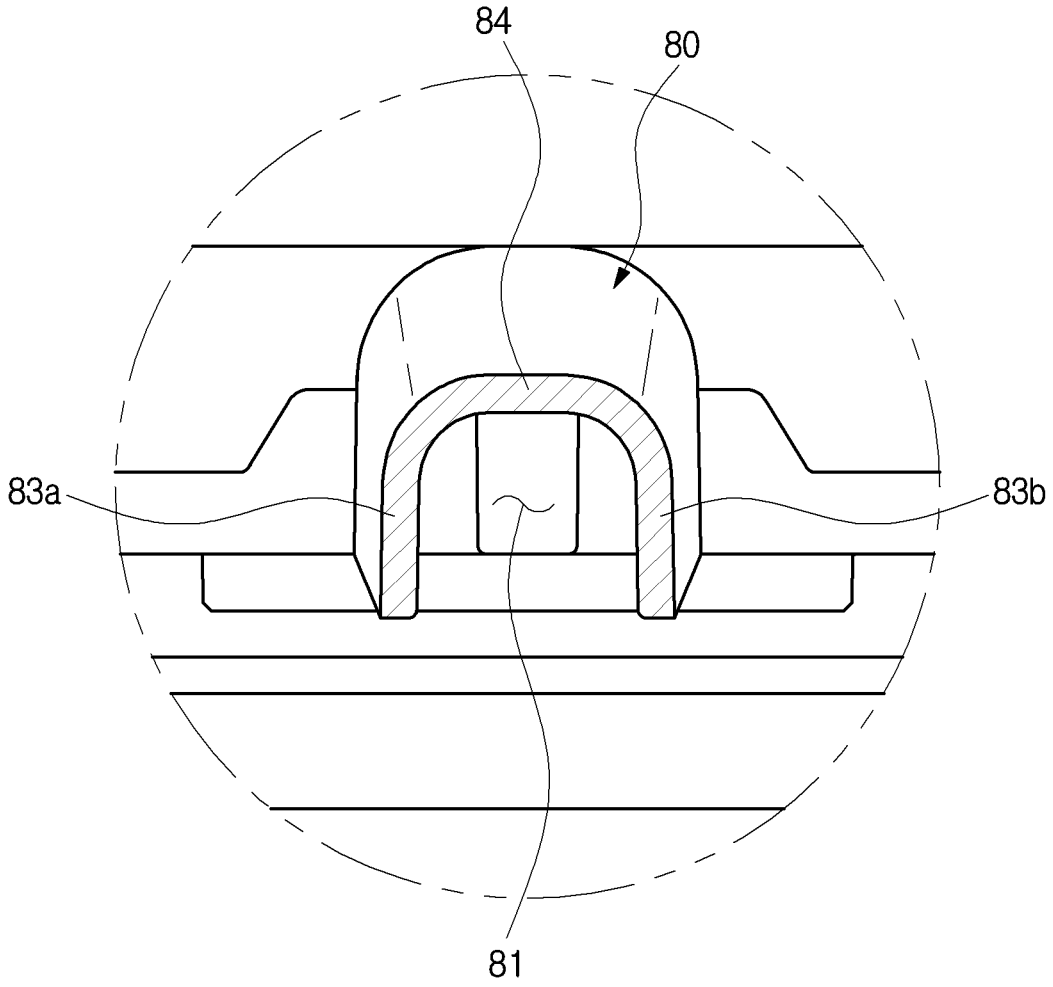
FIG. 10 illustrates a cross-sectional view along the line I-I of FIG. 6 according to an embodiment of the present disclosure.
Figure 11:
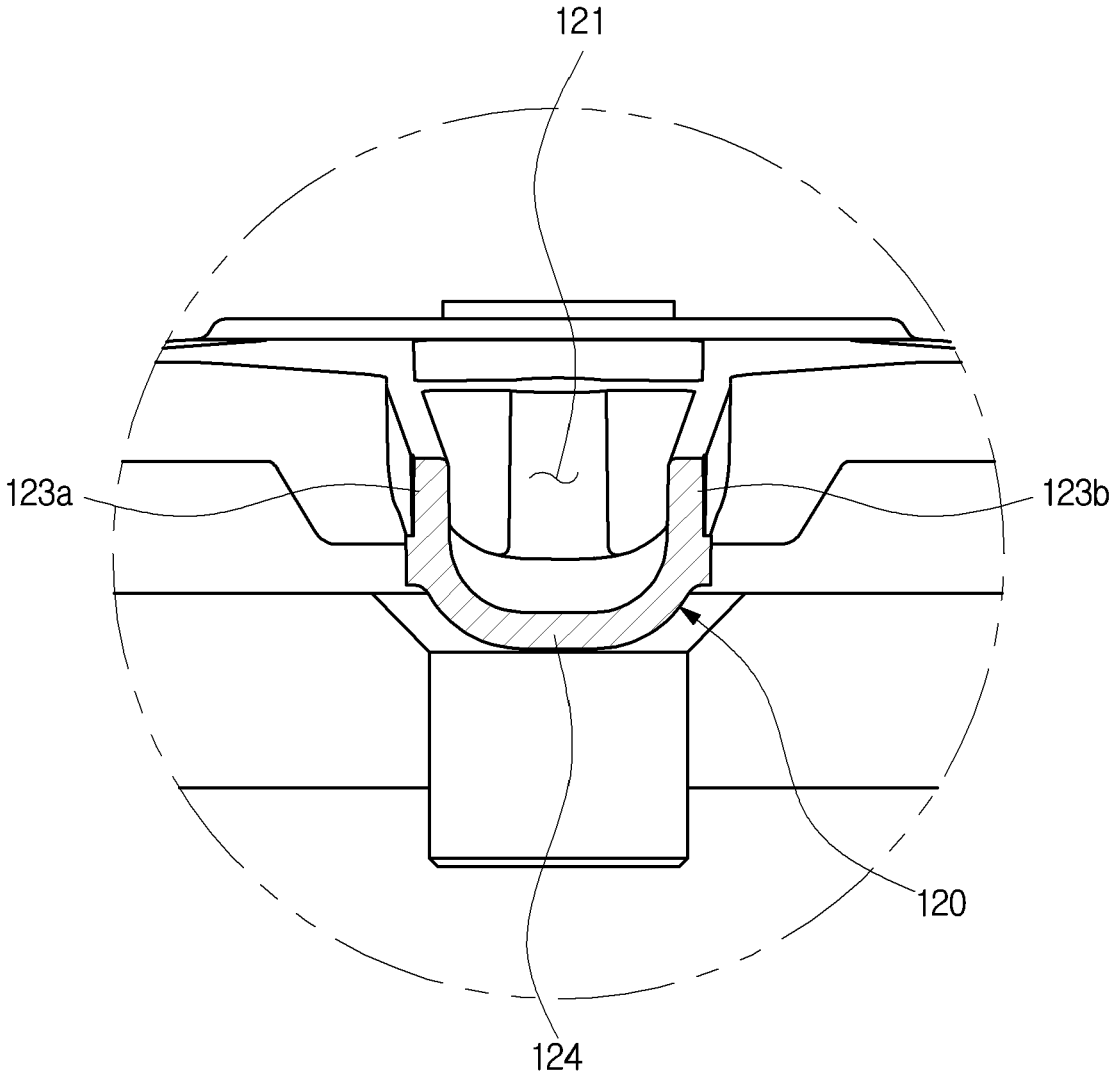
FIG. 11 illustrates a cross-sectional view along the line II-II of FIG. 8 according to an embodiment of the present disclosure.
Figure 12:
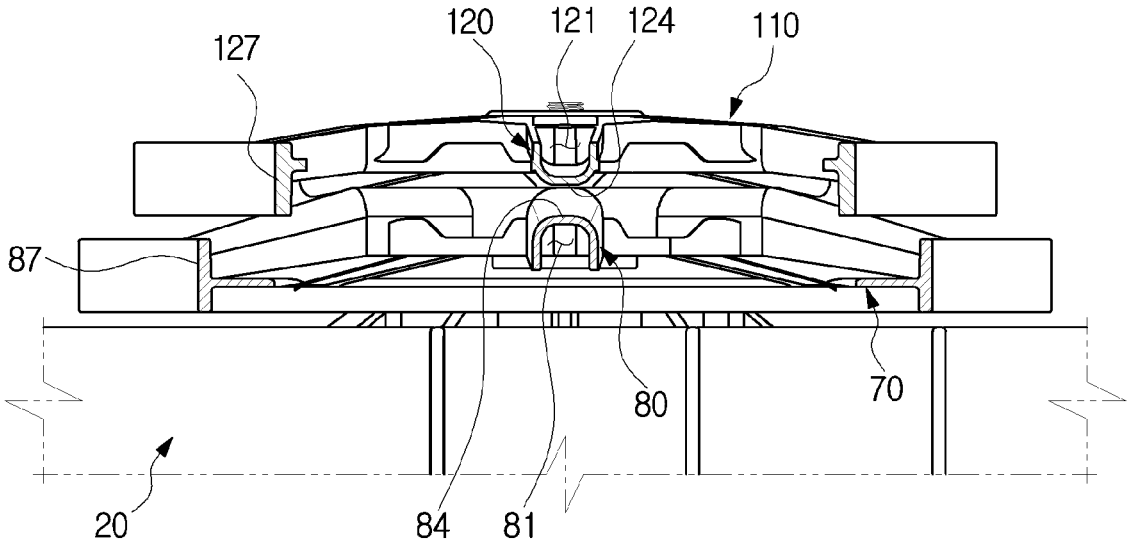
FIG. 12 illustrates arrangement of a first spoke recess of the first pulley and a second spoke recess of the second pulley of the washing machine of FIG. 1 according to an embodiment of the present disclosure.

FIG. 5 illustrates an enlarged side cross-sectional view of a part of the back of the washing machine of FIG. 1, according to an embodiment of the present disclosure. FIG. 6 illustrates a front perspective view of the first pulley of the washing machine of FIG. 1, according to an embodiment of the present disclosure. FIG. 7 illustrates a rear perspective view of the first pulley of the washing machine of FIG. 1, according to an embodiment of the present disclosure. FIG. 8 illustrates a front perspective view of the second pulley of the washing machine of FIG. 1, according to an embodiment of the present disclosure. FIG. 9 illustrates a rear perspective view of the second pulley of the washing machine of FIG. 1, according to an embodiment of the present disclosure. FIG. 10 illustrates a cross-sectional view along the line I-I of FIG. 6, according to an embodiment of the present disclosure. FIG. 11 illustrates a cross-sectional view along the line II-II of FIG. 8, according to an embodiment of the present disclosure. FIG. 12 illustrates arrangement of a first spoke recess of the first pulley and a second spoke recess of the second pulley of the washing machine of FIG. 1, according to an embodiment of the present disclosure.

Referring to FIGS. 5 to 12, shapes and assembly structures of the first pulley 70 and the second pulley 110 in accordance with an embodiment of the present disclosure will now be described.

The first pulley 70 may include a first hub 71 coupled to the outer shaft 90, at least one first spoke 80 radially extending from the first hub 71, and a first rim 87 connected to an end of the first spoke 80 and coupled with the first belt 63.

The first hub 71 may include a first cylinder part 72 having the form of a cylinder and a first shaft coupler 76 to be coupled to the outer shaft 90. The first shaft coupler 76 may be formed to protrude from the first cylinder part 72 toward the tub 20. Serration **76*a* may be formed on the inner circumferential face of the first shaft coupler 76 to be combined by serration with the serration 96 (see FIG. 2) formed on the outer circumferential face of the outer shaft 90**.

The first cylinder part 72 may include a first edge portion 73 and a first front portion 74. The at least one spoke 80 may extend from the outer circumferential face of the first edge portion 73, and the first shaft coupler 76 may protrude from the outer face of the first front portion 74.

A first nut receiver 75 may be formed inside the first cylinder part 72 to receive the first nut 89 that prevents the first pulley 70 from falling out of the outer shaft 90. The first nut receiver 75 may be formed by the inner circumferential face of the first edge portion 73 and the inner face of the first front portion 74. At least more than half of the first nut 89 may be received in the first nut receiver 75.

As such, the first nut 89 is received inside the first cylinder part 72 of the first hub 71, so that the first pulley 70 and the second pulley 110 may closely contact each other with respect to the longitudinal direction of the outer shaft 90, thereby increasing the washing space in the washing machine 1.

The at least one first spoke 80 may be radially formed for connecting the first hub 71 and the first rim 87. The first pulley 70 may be formed to have the center in the radial direction closer to the rear plate 12 of the tub 20 than the outer portions in the radial direction are. In other words, the first pulley 70 may have a convex form toward the rear plate 12 of the cabinet 10.

Specifically, the first spoke 80 may include a first extension 85 radially extending from the first hub 71 and a first inclined portion 86 slantingly extending from the first extension 85 and connected to the first rim 87, and the first inclined portion 86 may slantingly extend to be nearer to the tub 20 at an outer point in the radial direction.

The first spoke 80 may have a first spoke recess 81 formed to save the material and reduce the weight. As shown in FIG.

10, the first spoke 80 may include a first side wall 83*a* and another first side wall 83*b*, which extend in the longitudinal direction of the first spoke 80 and face each other, and a first link wall 84 linking an end of the first side wall 83*a* and an end of the other first side wall 83*b*. The first spoke recess 81 may be formed on the inside of the first side wall 83*a*, the other first side wall 83*b*, and the first link wall 84.

The first spoke recess 81 may be formed in the front of the first spoke 80. In other words, it may be formed to open up toward the tub 20.

A first reinforcing rib 82 may be formed in the first spoke recess 81 to reinforce the strength of the first spoke 80. The first reinforcing rib 82 may be formed in a direction crossing the first spoke recess 81.

The second pulley 110 may include a second hub 111 coupled to the inner shaft 130, at least one second spoke 120 radially extending from the second hub 111, and a second rim 127 connected to an end of the second spoke 120 and coupled with the second belt 103.

The second hub 111 may include a second cylinder part 112 having the form of a cylinder and a second shaft coupler 116 to be coupled to the inner shaft 130. The second shaft coupler 116 may be formed to protrude from the second cylinder part 112 toward the tub 20.

Serration 116*a* may be formed on the inner circumferential face of the second shaft coupler 116 to be combined by serration with the serration 134 (see FIG. 2) formed on the outer circumferential face of the inner shaft 130.

The second shaft coupler 116 may be inserted to the cavity 92 of the outer shaft 90. Specifically, the cavity 92 of the outer shaft 90 may include a center cavity 92*a* formed at a middle portion in the longitudinal direction and an end cavity 92*b* formed at the end in the longitudinal direction of the outer shaft 90. The second shaft coupler 116 may be inserted to the end cavity 92*b*. The diameter D2 (see FIG. 5) of the end cavity 92*b* may be larger than the diameter D1 of the center cavity 92*a*.

At least a half of the second shaft coupler 116 in the longitudinal direction may be inserted to the end cavity 92*b*.

The second shaft coupler 116 may be inserted to the cavity 92 of the outer shaft 90 to be arranged at a position corresponding to the first nut 89 with respect to the longitudinal direction of the outer shaft 90. From another perspective, it can be said that the second shaft coupler 116 may be located on the inner side of the radial direction of the first nut 89.

As such, the second shaft coupler 116 is inserted to the cavity 92, so that the first pulley 70 and the second pulley 110 may closely contact each other with respect to the longitudinal direction of the outer shaft 90, thereby increasing the washing space in the washing machine 1.

The diameter D3 (see FIG. 5) of the outer circumference of the second shaft coupler 116 may be smaller than the diameter D2 of the end cavity 92*b* to prevent the second shaft coupler 116 and the end cavity 92*b* from rubbing against each other while the second pulley 110 is rotating.

The second shaft coupler 116 may include a fillet portion 118 provided at a connecting portion with the second cylinder part 112 to reinforce the strength of the second shaft coupler 116. The diameter D4 of the outer circumference of the fillet portion 118 may be larger as it becomes nearer to the second cylinder part 112.

The second cylinder part 112 may include a second edge portion 113 and a second front portion 114. The at least one second spoke 120 may extend from the outer circumferential face of the second edge portion 113, and the second shaft coupler 116 may protrude from the outer face of the second front face 114.

A second nut receiver 115 may be formed inside the second cylinder part 112 to receive the second nut 129 that prevents the second pulley 110 from falling out of the inner shaft 130. The second nut receiver 115 may be formed by the inner circumferential face of the second edge portion 113 and the inner face of the second front portion 114. At least more than half of the second nut 129 may be received in the second nut receiver 115.

As such, the second nut 129 is received inside the second cylinder part 112 of the second hub 111, so that the second pulley 110 and the rear plate 12 of the cabinet 10 may closely contact each other with respect to the longitudinal direction of the inner shaft 130, thereby increasing the washing space in the washing machine 1.

The at least one second spoke 120 may be radially formed for connecting the second hub 111 and the second rim 127. The second pulley 110 may be formed to have the center in the radial direction closer to the rear plate 12 of the tub 20 than the edge portions in the radial direction are. In other words, the second pulley 110 may have a convex form toward the rear plate 12 of the cabinet 10. The reason that the second pulley 110 is convex toward the rear plate 12 of the cabinet 10 is to minimize a contact area between the second pulley 110 and the rear plate 12 of the cabinet 10 when the second pulley 110 moves toward the rear plate 12 of the cabinet 10 due to vibration during rotation of the second pulley 110, thereby reducing shocks, noise, and damage.

Specifically, the second spoke 120 may include a second extension 125 radially extending from the second hub 111 and a second inclined portion 126 slantingly extending from the second extension 125, and the second inclined portion 126 may slantingly extend to be nearer to the tub 20 at an outer point in the radial direction.

The second spoke 120 may have a second spoke recess 121 formed to save the material and reduce the weight. As shown in FIG. 11, the second spoke 120 may include a second side wall 123*a* and another second side wall 123*b*, which extend in the longitudinal direction of the second spoke 120 and face each other, and a second link wall 124 linking an end of the second side wall 123*a* and an end of the other second side wall 123*b*. The second spoke recess 121 may be formed on the inside of the second side wall 123*a*, the other second side wall 123*b*, and the second link wall 124.

The second spoke recess 121 may be formed in the back of the second spoke 120. In other words, it may be formed to open up toward the rear plate 12 of the cabinet 10.

As such, both the first pulley 70 and the second pulley 110 have a convex form toward the opposite side of the tub 20, i.e., toward the rear plate 12 of the cabinet, but the first spoke recess 81 and the second spoke recess 121 are formed on the opposite sides. Especially, the first spoke recess 81 is formed in the front of the first spoke 80 and the second spoke recess 121 is formed in the back of the second spoke 120. From another perspective, the first link wall 84 and the second link wall 124 may be formed to face each other.

This is because, considering the fact that the concave form of the first spoke recess 81 and the second spoke recess 121 may lead to flow induced noise during rotation of the first and second pulleys 70 and 110, the flow induced noise may be minimized by the structure in which the first spoke recess 81 is formed in the front of the first spoke 80 and the second spoke recess 121 is formed in the back of he second spoke 120 as in the embodiment of the present disclosure. From another perspective, the flow induced noise may be minimized by the structure in which the first link wall 84 and the second link wall 124 may face each other.

A second reinforcing rib 122 may be formed in the second spoke recess 121 to reinforce the strength of the second spoke 120. The second reinforcing rib 122 may be formed in a direction crossing the second spoke recess 121.

According to embodiments of the present disclosure, a washing machine with a structure having a plurality of pulleys to drive a drum and a pulsator may increase washing space inside the washing machine.

According to embodiments of the present disclosure, a washing machine with a structure having a plurality of pulleys to drive a drum and a pulsator may reduce noise caused by rotation of the plurality of pulleys.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A washing machine comprising:

a tub;

a drum rotationally provided inside the tub to receive an object to be washed;

a pulsator rotationally provided inside the drum;

an outer shaft connected to the drum and including a cavity;

an inner shaft connected to the pulsator and arranged in the cavity;

a first pulley including a first axial coupler coupled to the outer shaft; and a second pulley including a second axial coupler protruding from the second pulley toward the tub, the second axial coupler arranged in the cavity of the outer shaft and coupled to the inner shaft.

2. The washing machine of claim 1, wherein the cavity comprises a center cavity formed at a middle portion in a longitudinal direction of the outer shaft, and an end cavity including a larger diameter than the center cavity and formed at an end in the longitudinal direction of the outer shaft, and wherein the second axial coupler is arranged in the end cavity.

3. The washing machine of claim 2, wherein a diameter of an outer circumference of the second axial coupler is smaller than the diameter of the end cavity.

4. The washing machine of claim 1, wherein at least a half of the second axial coupler in a longitudinal direction is arranged in the cavity.

5. The washing machine of claim 1, wherein the first pulley comprises a first hub, a first spoke radially extending from the first hub, and a first rim connected to an end of the first spoke, wherein the first hub comprises a first cylinder part and the first axial coupler, and wherein the first axial coupler protrudes from the first cylinder part.

6. The washing machine of claim 5, further comprising: a first nut coupled to an outer circumferential face of the outer shaft to prevent the first pulley from falling out of the outer shaft.

7. The washing machine of claim 6, wherein the second axial coupler is arranged at a position corresponding to the first nut with respect to a longitudinal direction of the outer shaft.

8. The washing machine of claim 6, wherein the first hub comprises a first nut receiver concavely formed to receive the first nut.

9. The washing machine of claim 8, wherein the first nut receiver is formed inside the first cylinder part.

10. The washing machine of claim 1, wherein the second pulley comprises a second hub, a second spoke radially extending from the second hub, and a second rim connected to an end of the second spoke, wherein the second hub comprises a second cylinder part and the second axial coupler, and wherein the second axial coupler protrudes from the second cylinder part.

11. The washing machine of claim 10, wherein the second axial coupler comprises a fillet portion provided to be connected to the second cylinder part to reinforce the second axial coupler, and wherein the fillet portion has a larger outer circumferential diameter as it becomes nearer to the second cylinder part.

12. The washing machine of claim 10, further comprising: a second nut coupled to an outer circumferential face of the inner shaft to prevent the second pulley from falling out of the inner shaft.

13. The washing machine of claim 12, wherein the second hub comprises a second nut receiver concavely formed to receive the second nut.

14. The washing machine of claim 13, wherein the second nut receiver is formed inside the second cylinder part.

* * * * *